US005250275A

United States Patent [19]

Pavinato et al.

[11] Patent Number: 5,250,275

[45] Date of Patent: Oct. 5, 1993

[54] PROCESS FOR SEPARATING SILICON COMPOUNDS CONTAINED IN A HYDROCHLORIC BATH USED FOR PICKLING

[75] Inventors: Albert Pavinato, Piennes; Richard Pazdej; Rémy Nicolle, both of Maizieres-Lès-Metz, all of France

[73] Assignee: Sollac, Puteaux, France

[21] Appl. No.: 803,207

[22] Filed: Dec. 6, 1991

[30] Foreign Application Priority Data

Dec. 13, 1990 [FR] France ..... 90 15621

[51] Int. Cl.[5] ..... C02F 9/00; C02F 1/60; C02F 1/64

[52] U.S. Cl. ..... 423/138; 423/150.3; 423/324; 423/DIG. 1

[58] Field of Search ..... 423/DIG. 1, 339, 138, 423/349, 346, 324, 140, 325, 594, 150.3, 658.5

[56] References Cited

U.S. PATENT DOCUMENTS

| | | | |
|---|---|---|---|
| 3,310,435 | 3/1967 | Robinson et al. | 423/DIG. 1 |
| 3,442,608 | 5/1969 | Addinall et al. | 423/DIG. 1 |
| 4,086,321 | 4/1978 | Holley et al. | 423/DIG. 1 |
| 5,032,369 | 7/1991 | Kondo et al. | 423/339 |

FOREIGN PATENT DOCUMENTS

| | | |
|---|---|---|
| 2729535 | 1/1978 | Fed. Rep. of Germany . |
| 54-138893 | 4/1978 | Japan . |
| 59-162139 | 9/1984 | Japan . |
| 62-59532 | 3/1987 | Japan . |
| 63-40728 | 2/1988 | Japan . |
| 63-112425 | 5/1988 | Japan . |
| 63-129019 | 6/1988 | Japan . |
| 63-144121 | 6/1988 | Japan . |
| 63-144122 | 6/1988 | Japan . |
| 63-144123 | 6/1988 | Japan . |
| 63-315523 | 12/1988 | Japan . |
| 1126232 | 9/1968 | United Kingdom . |

OTHER PUBLICATIONS

Patent Abstracts of Japan, vol. 8, No. 178 (C238) [1605], Aug. 16, 1984, & JP-A-59 073 439, Apr. 25, 1984, T. Yasutaka, "Production of Iron Oxide From Waste Hydrochloric Acidliquor for Pickling".

*Primary Examiner*—David Brunsman

*Attorney, Agent, or Firm*—Oblon, Spivak, McClelland, Maier & Neustadt

[57] ABSTRACT

This process in which the used bath is recycled after concentration at (1) by elimination of water at (2), followed by a treatment for recovering iron oxides at (10), is characterized in that it comprises carrying out a tangential microfiltration at (5) of the concentrated bath so as to separate therefrom the silicon compounds in the non-ionic form and thereby concentrate them, and recirculating the major part of the fraction of this bath (11–17) containing these concentrated silicon compounds so as to promote the precipitation of the non-ionic compounds of the silicon.

8 Claims, 1 Drawing Sheet

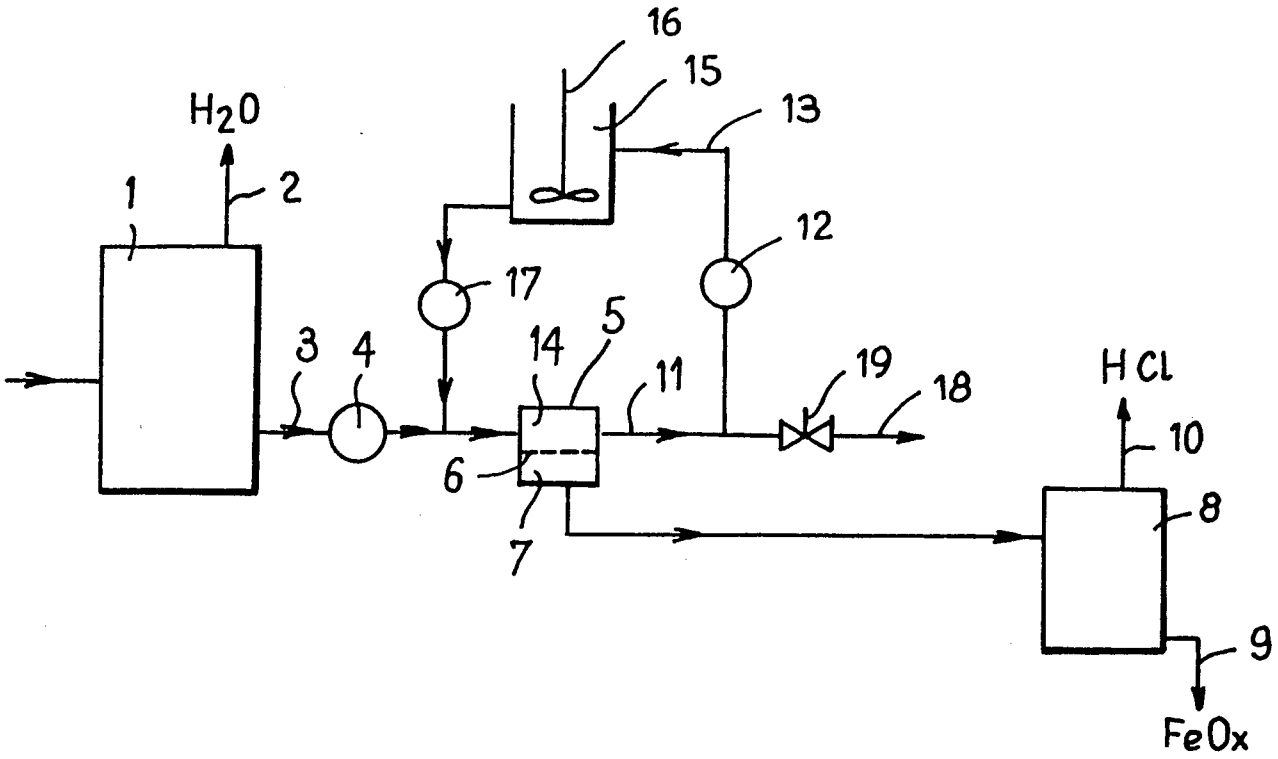
1
$H_2O$
2
3
4
17
16
15
13
12
5
14
6
7
11
19
18
HCl
10
8
9
FeOx

PROCESS FOR SEPARATING SILICON COMPOUNDS CONTAINED IN A HYDROCHLORIC BATH USED FOR PICKLING

The present invention relates to a process for separating silicon compounds contained in a hydrochloric bath used for pickling metal work pieces, in particular steel pieces such as sheets.

These used baths—which may be recycled after concentration, various treatments and regeneration—contain silicon compounds and iron compounds, the latter having many industrial applications.

The document EP-A-0 141 034 discloses a process for separating silicic compounds from a used steel pickling bath by means of a filter comprising a material which absorbs the silicic compounds. This process requires a large volume of absorbent material relative to the volume of the used bath to be treated and, moreover, the silicon remaining in the ionic form cannot be filtered.

An object of the present invention is to provide a process for separating silicon compounds from pickling baths so as to recover iron oxides which are sufficiently pure to be of subsequent value.

The used baths coming from the line for pickling sheet metals with hydrochloric acid usually contain 120 to 150 g/l of iron, and 30 to 40 mg/l of silicon about 90% of which is in the non-filterable ionic form. The non-ionic fraction is essentially composed of micellar polymer forms which are capable of forming gels. These sols-gels are filterable. . When the pickling bath is subjected to a treatment for recovering iron oxides and then recycled, the concentration of iron in the concentrated used bath obtained after elimination of water (conventionally by evaporation) is 180 to 280 g/l depending on the processes employed (e.g. RUTHNER or LURGI), whereas the concentration of silicon may increase from 30–40 to 60 mg/l and more, of which about 70 to 80% is in the non-ionic form and 20 to 30% in the ionic form. Further, a higher concentration of the bath, which would promote the formation of precipitable silicic compounds, is not possible without simultaneously precipitating the iron, in particular $FeCl_2$, which is of course undesirable.

The inventors of the present invention have now found that it is possible to highly reduce the concentration of silicon compounds in the concentrated used bath by a tangential microfiltration of the bath, combined with a recirculation of a part of the bath in which the silicon compounds are concentrated and then precipitated.

The invention therefore provides a process for separating silicon compounds contained in a hydrochloric bath for pickling steel work pieces, in which the used bath is recycled after concentration by elimination of water, in particular by evaporation of 20 to 50% by weight for example, and preferably 30 to 40%, followed by a treatment for recovering iron oxides, characterized in that it comprises carrying out a solid-liquid separation operation on the concentrated bath so as to separate the silicon compounds in the non-ionic form and thereby concentrate them, and recycling the major part of the fraction of said bath containing said concentrated silicon compounds so as to promote the precipitation of the silicon compounds in the non-ionic form, the other part of said fraction being discharged.

The silicic compounds thus precipitated are discharged at the same time as a part of the concentrate of the silicon compounds in the non-ionic form, but with only a negligible part of the bath. In this way, the fraction of the concentrated bath in recirculation contains a concentration of silicic compounds which is distinctly higher than the rest of the bath and yet has the same concentration of iron, which is present only in the ionic state.

The solid-liquid separation on the concentrated bath is carried out in particular by tangential microfiltration by means of a membrane having a cut off threshold of 0.2 μm. This membrane is advantageously a porous carbon-carbon fibre composite such as the product "LCL" sold by the firm Carbone Lorraine. Such a membrane permits separating the quasi-totality of the non-ionic silicon while having no influence on the compounds of the iron, i.e. a 100% selectivity.

Preferably, the temperature of the concentrated bath is in the range of 50° C. to 90° C.

Advantageously, the fraction of the concentrated bath in recirculation is agitated so as to promote the maturation of the micellae of insoluble silicic compounds. This effect may also be achieved by increasing the acidity of this fraction of the bath. It is all the more pronounced as the time the concentrated bath takes to pass through this recirculation loop is longer.

As will be understood, the invention basically consists in a single treatment operation permitting both the recovery of the iron and the elimination of the silica associated with a judicious choice of the place at which this treatment is carried out in the line of the usual operations, namely at the output end of the concentrator acting by elimination of water. It will have been noticed that it is the increase in the concentration of colloidal silica (i.e. the non-ionic form) which is the factor promoting the precipitation of the still soluble fraction of the compounds of the silica, namely the ionic silica. The explanation of this phenomenon has not yet been completely elucidated by the inventors.

BRIEF DESCRIPTION OF THE DRAWING

The following example illustrates the invention with reference to the accompanying single FIGURE which is a block diagram of a treatment installation.

There is brought from a steel sheet hydrochloric pickling line (not shown in the FIGURE) 5 cu.m/h of a used bath containing 140 g/l of iron and 35 mg/l of silicon into a concentrator 1 from which about 35% is evaporated at high temperature. The concentrated used bath 3 leaving this device (3.15 cu.m/h at about 70° C.) containing 250 g/l of iron and 53 mg/l of silicon, is introduced by means of a pump 4 into a tangential microfiltration (TMF)5 tank comprising mainly a series of diaphragms 6 of carbon-carbon composite having a cut off threshold of 0.2 μm which divide it into two chambers. The permeate contains substantially no longer any non-ionic silicon, and about 11 mg/l of silicon compounds in the ionic form are collected in the lower chamber 7 to the extent of 3.10 cu.m/h from which it is directed to a pyrohydrolysis treatment 8 in accordance with the RUTHNER or LURGI process for the purpose of the recovery of the iron oxides at 9, then it is recycled through the outlet 10 in the pickling line.

The major part of the supernatant 11 concentrated in compounds of insoluble silicon in the sol-gel form, is put into recirculation by means 12, 17 to the extent of 0.65 cu.m/min in a branch circuit 13 of a line leading from the upper chamber 14 of the (TMF)5 tank to the upstream side of this tank. The rest of the supernatant, representing about 2% of the permeate flow (0.05 cu.m/h in the presently described embodiment) is discharged from the installation through a discharge circuit 18 provided with means 19 for regulating the discharge flow. The ratio between the discharge flow and the permeate flow results from a compromise between the different operational parameters of the installation. A low discharge flow permits recovering a large quantity of compounds of silica but on the other hand it requires a frequent cleaning of the microfiltration diaphragm. For a given area of diaphragm, the installation is therefore stopped for a longer period than in the case of a high discharge flow. The discharge flow must therefore be optimized so as to obtain a satisfactory productivity of the installation.

The recirculation circuit 13 serving to achieve the silicon concentration advantageously comprises a reserve vessel 15 provided with an agitating system 16 for promoting the maturation of the micellae of insoluble silicic compounds and means 12, 17 for circulating the bath. It may also include means for increasing the acidity of the bath again to promote the precipitation of the silicon compounds.

Thus the process according to the invention permits improving the purity of the iron oxides recovered from the used bath which is concentrated and desilicated with only relatively slight losses of bath concentrated in silicon which is rejected.

It must be understood that the tangential microfiltration is only an example of a separating method which may be employed. Any other solid-liquid separation method having a cut off threshold adapted to the filtration of silicic compounds, may be employed.

What is claimed is:

1. A process for separating silicon compounds from a hydrochloric acid bath used for pickling steel, comprising:

(A) evaporating water from said bath, thus concentrating said bath;

(B) carrying out a solid-liquid separation on the concentrated bath by tangential microfiltration, to separate said concentrated bath into a supernatant containing concentrated non-ionic silicon compounds and a permeate containing iron compounds and no non-ionic silicon compounds;

(C) recirculating a major part of said supernatant, to promote precipitation of said concentrated non-ionic silicon compounds;

(D) treating said permeate to recover said iron compounds;

(E) recycling the treated permeate to said hydrochloric acid bath; and (F) discharging a minor part of said supernatant.

2. The process of claim 1, wherein said evaporating step evaporates from 20 to 50% of the water from said bath.

3. The process according to claim 1, wherein said tangential microfiltration operation is carried out by means of a diaphragm having a cut off threshold of 0.2 μm.

4. The process according to claim 1, wherein said diaphragm is a carbon-carbon composite.

5. The process according to claim 1, wherein the temperature of said concentrated bath is 50° C. to 90° C.

6. The process according to claim 1, further comprising agitating the major fraction of the supernatant in recirculation.

7. The process according to claim 1, further comprising acidifying the major fraction of the supernatant.

8. The process of claim 1, wherein said concentrated non-ionic silicon compounds are precipitated, and said minor part of said supernatant discharged contains said precipitated non-ionic silicon compounds.

* * * * *